US007856989B2

(12) United States Patent
Karles et al.

(10) Patent No.: US 7,856,989 B2
(45) Date of Patent: Dec. 28, 2010

(54) ELECTROSTATICALLY PRODUCED FAST DISSOLVING FIBERS

(75) Inventors: Georgios D. Karles, Richmond, VA (US); Diane Gee, Richmond, VA (US); John Layman, Chester, VA (US)

(73) Assignee: Philip Morris USA Inc., Richmond, VA (US)

( * ) Notice: Subject to any disclaimer, the term of this patent is extended or adjusted under 35 U.S.C. 154(b) by 672 days.

(21) Appl. No.: 11/312,656

(22) Filed: Dec. 21, 2005

(65) Prior Publication Data

US 2006/0264130 A1 Nov. 23, 2006

Related U.S. Application Data

(60) Provisional application No. 60/640,097, filed on Dec. 30, 2004.

(51) Int. Cl.
*A24D 3/06* (2006.01)

(52) U.S. Cl. ..... 131/337; 131/332; 131/335; 131/345

(58) Field of Classification Search ..... None
See application file for complete search history.

(56) References Cited

U.S. PATENT DOCUMENTS

| | | | | |
|---|---|---|---|---|
| 4,323,525 | A | 4/1982 | Bornat | |
| 5,041,252 | A * | 8/1991 | Fujii et al. | 264/176.1 |
| 5,516,815 | A * | 5/1996 | Buehler et al. | 523/128 |
| 5,998,511 | A | 12/1999 | Westland et al. | |
| 6,062,228 | A * | 5/2000 | Loercks et al. | 131/332 |
| 6,110,590 | A | 8/2000 | Zarkoob et al. | |
| 2002/0166563 | A1* | 11/2002 | Jupe et al. | 131/331 |
| 2003/0017208 | A1 | 1/2003 | Ignatious et al. | |
| 2003/0106294 | A1 | 6/2003 | Chung et al. | |
| 2003/0137083 | A1 | 7/2003 | Ko et al. | |
| 2004/0127460 | A1* | 7/2004 | Wolf | 514/54 |
| 2005/0073075 | A1* | 4/2005 | Chu et al. | 264/465 |
| 2007/0035055 | A1 | 2/2007 | Gee et al. | |

FOREIGN PATENT DOCUMENTS

JP 62156348 A * 7/1987

OTHER PUBLICATIONS

Derwent, Derwent-ACC-No. 1987-232178, 1987, Derwent Information Ltd.*

Darrell H. Reneker and Iksoo Chun, Nanometre diameter fibres of polymer, produced by electrospinning, Nanotechnology 7 (1996), pp. 216-223.

Phillip Gibson, Heidi Schreuder-Gibson and Christopher Pentheny, Electrospinning Technology: Direct Application of Tailorable Ultrathin Membranes, Journal of Coated Fabrics, vol. 28-Jul. 1998, pp. 63-72.

(Continued)

*Primary Examiner*—Carlos Lopez
*Assistant Examiner*—Michael J Felton
(74) *Attorney, Agent, or Firm*—Buchanan Ingersoll & Rooney PC

(57) ABSTRACT

Fibrous structures composed of electrostatically prepared polysaccharide micro- and nanofibers are described which contain active agents such as drugs and/or flavorants encapsulated within the structures. When exposed to moisture, the structures are disrupted and the active agent rapidly released. The fibrous structures containing active agents such as flavorants can be incorporated into smoking articles which, when smoked, release the flavorants.

24 Claims, 1 Drawing Sheet

OTHER PUBLICATIONS

C. Drew, X. Wang, K. Senecal, H. Schreuder-Gibson, J. He, S. Tripathy and L. Samuelson, Electrospun Nanofibers of Electronic and Photonic Polymer Systems, Conference Proceedings, vol. II—Materials, ANTEC 2000, May 7-11, 2000, Orlando, Florida.

Jamil A. Matthews, Gary E. Wnek, David G. Simpson, and Gary L. Bowlin, Electrospinning of Collagen Nanofibers, Biomacromolecules, vol. 3, No. 2, 2002, 2002 American Chemical Society, pp. 232-238.

El-Refaie Kenawy, Gary L. Bowlin, Kevin Mansfield, John Layman, David G. Simpson, Elliot H. Sanders, Gary E. Wnek, Release of tetracycline hydrochloride from electrospun poly(ethylene-co-vinylacetate), poly(lactic acid), and a blend, Journal of Controlled Release 81 (2002), pp. 57-64.

W.E. Hennink, C.F. van Nostrum, Novel crosslinking methods to design hydrogels, Advanced Drug Delivery Reviews 54 (2002), pp. 13-36.

Gary L. Bowlin, Kristin J. Pawlowski, Eugene D. Bowland, David G. Simpson, John B. Fenn, Gary E. Wnek, and Joel D. Stitzel, Electrospinning of Polymer Scaffolds for Tissue Engineering, Marcel Dekker, Inc. (2002), pp. 165-178.

* cited by examiner

ELECTROSTATICALLY PRODUCED FAST DISSOLVING FIBERS

This application claims priority under 35 U.S.C. §119 to U.S. Provisional Application No. 60/640,097 entitled ELECTROSTATICALLY PRODUCED FAST DISSOLVING FIBERS, filed Dec. 30, 2004, the entire content of which is hereby incorporated by reference.

FIELD OF THE INVENTION

This invention relates to electrostatic processing of polysaccharide formulations to form fast dissolving fibers particularly suitable for entraining and encapsulating drugs, flavorants and the like.

BACKGROUND

Electrostatic processing is a known technique for producing fibers having a very small diameter and particularly nanofibers having diameters on the order of about 1 to about 100 nanometers. Electrostatic processing can also be employed to manufacture microfibers having diameters in the range of about 0.1 microns to about 10 microns.

In general, electrostatic processing techniques employ an electrostatic force to draw a charged liquid polymeric formulation from a source to a collector. An electrostatic field is used to accelerate the liquid formulation from the source to the collector on which the electrostatically processed polymer is collected.

SUMMARY

Methods are provided for the production of electrostatically prepared nanofibers and microfibers derived from polysaccharides. The process generally comprises dissolving or dispersing a polysaccharide in an aqueous solvent, electrostatically processing the dissolved or dispersed polysaccharide and recovering the product. Preferably, known electospinning techniques are employed to produce the fibrous structure.

In another embodiment, a mixture of a polysaccharide and an active agent such as a drug and/or flavorant is dissolved or dispersed in an aqueous solvent, the dissolved or dispersed mixture electrostatically processed and a non-woven fibrous structure collected comprising the active agent entrained or encapsulated within a polysaccharide fibrous web.

Another embodiment comprises incorporating into a smoking article a fibrous structure composed of an active agent such as a flavorant contained within a web of electrostatically produced polysaccharide nanofibers or microfibers.

Still another embodiment comprises treating mainstream tobacco smoke by drawing the smoke through a cigarette containing a flavorant encapsulated within a fibrous web of polysaccharide microfibers or nanofibers whereby moisture in the smoke releases the flavorant into the mainstream smoke.

DETAILED DESCRIPTION OF PREFERRED EMBODIMENTS

Figure 1:
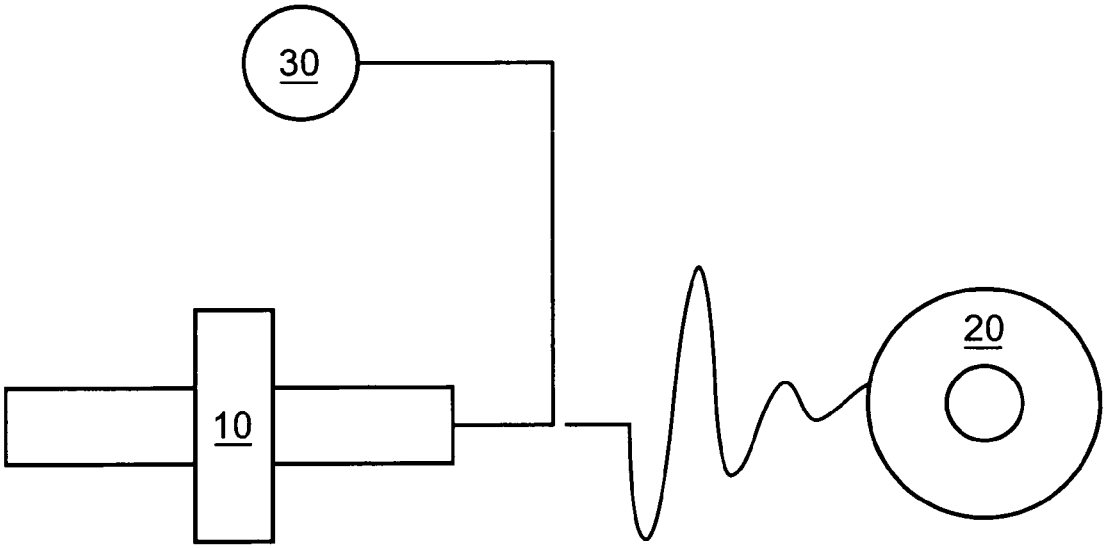
FIG. 1 shows an apparatus suitable for electrostatically processing polysaccharide formulations into fibers.

As used herein, the term "electrostatic processing" includes electrostatic spinning (electrospinning) and electrostatic spraying (electrospraying) techniques. Electrospinning produces fibers, and electrospraying produces droplets or clusters of droplets. The electrospun fibers may be continuously collected on a collection screen while the electrosprayed droplets or droplet clusters may be collected on a collection screen in the form of fibers.

An electrostatically processed material can be formed by electrospinning or electrospraying a polymer formulation by manipulating components of the polymer system and/or changing various process parameters, such as applied voltage, distance from the feeding stage to the collection stage, volumetric flow rate, and the like. In addition, whether a polymer formulation electrospins or electrosprays can be controlled by changing physical characteristics of the polymer formulation, such as changes in concentration, solvent selection, polymer molecular weight, polymer branching, and the like.

The fibrous products used herein can be prepared by any one of several known techniques. Electrospinning methods have been available since the 1930's. In general, electrospinning techniques involve generating a high voltage electric field and applying the voltage to polymeric liquids fed through a container containing the polymer solution, usually a glass syringe. A fine stream of the polymeric liquid is pulled from the syringe and attracted to a metallic collection screen. As the charged liquid stream is attracted to the screen, the solvent or dispersing fluid in the polymeric liquid quickly evaporates and polymer randomly accumulates on the collection target in the form of nanofibers or microfibers. Also, the fibers could be collected on a moving metallic belt as a non-woven fibrous structure.

The technique of electroprocessing thus uses a delivery device, an electric field, and a capture point, which may include a capture or collection device. The delivery point is simply a place where at least one droplet of the polymeric system can be introduced or exposed to an electric field. The capture point is simply a place where the stream or jet of polymeric fibers or droplets can be collected. It is preferred that the delivery point and capture point be conductive so as to be useful in creating the electric field. But it should be understood that the apparatus is not limited to this type of configuration or setup inasmuch as the delivery point and capture point can be non-conductive points that are simply located within or adjacent to an electric field.

The electric field should be strong enough to overcome gravitational forces on the polymeric solution, overcome surface tension forces of the polymeric system, provide enough force to form a stream or jet of solution in space, and accelerate that stream or jet along the electric field. As the skilled artisan will recognize, surface tension is a function of many variables. These variables include the type of polymer, the type of solvent, the solution concentration, the presence of cosolvents or additives and the temperature. It may be useful to electroprocess within a vacuum environment because greater electrical forces can be used within the vacuum.

In electrospinning, the concentration of the polymeric system should be high enough so that randomly coiled polymeric molecules within the solution can come together and form an array of fibers. Preferably, the polymeric solutions utilized should contain about 20 to 60 weight percent polymers, more preferably 25 to 50 weight percent, most preferably 30 to 40 weight percent.

In a preferred embodiment, the electroprocessing apparatus is configured as illustrated in FIG. 1, so that the polymeric stream is pulled horizontally through space. As illustrated in FIG. 1, a delivery device 10, which is a syringe, a grounded collecting device 20, and a power supply 30 for generating an electric field are present. As noted above, the technique employed in electroprocessing the polymeric systems need not employ a delivery device that horizontally delivers the polymeric system to the electric field. It has been found to be particularly useful to employ this configuration because the horizontal delivery configuration can be used in conjunction with a pumping device that allows the polymeric system to be pumped to the tip of the delivery device at a constant volume rate so that skins that are sometimes found on the surface of the polymeric system are continuously broken as the polymeric system is delivered to the electric field. It should be appreciated that the dripping of the polymeric system from the delivery device should be avoided. This may be accomplished by properly controlling the feed rate of the polymer solution to the delivery point. The skilled artisan will appreciate that there are other ways by which one could control the delivery of the polymeric system to the electric field. Other techniques include manipulating the size of the orifice of the delivery device, or manipulating the air pressure above the system within the delivery device.

The polymeric solution is introduced to the electrified field via a charged delivery device. The delivery device should include an orifice that is capable of delivering a controlled amount of polymeric solution. The preferred orifice has a diameter from about 0.5 to about 1.0 mm. As noted above, it is preferred that the polymeric solution be delivered to the electric field horizontally so that gravitational forces do not introduce an excess amount of polymer into the electric field. In one example (as shown in FIG. 1), a polymeric solution is delivered to an electric field via a horizontally mounted syringe (10). In another example, a pipet containing a conductive portion, such as a wire, can be used. The skilled artisan will be able to readily select other delivery devices that can deliver a controlled amount of the polymeric solution to the electric field. A delivery device is not necessary for carrying out the electrostatic processing inasmuch as fibers can be produced from a single droplet of solution.

Preferably, the stream of fiber from the polymeric solution is delivered to a collecting or capturing device (20). Examples of a collecting or capturing device include, but are not limited to, a wire mesh, a polymeric mesh, a rotating cylinder, a metal grid, metal foil, paper, a syringe needle, a degradable substrate such as a degradable polymer fiber, an electrospun substrate, and the like. The skilled artisan will be able to readily select other devices that can be employed to capture the fibers as they travel through the electric field. The collecting or capturing device is preferably grounded to attract the charged fibers.

The collecting or capturing device can be of different morphologies and geometries and the electrostatically produced fibers can acquire these different geometries when dried. An example of a specific geometry may be a web of a single layer, multiple layers, interlaced fibers of different sources, and the like.

As the skilled artisan will recognize, the electric field necessary to create a stream of fibers through space can be achieved by charging the delivery device or the capture device. Where the delivery device is charged, the capture device will be grounded (as illustrated in FIG. 1); and where the capture device is charged, the delivery device will be grounded.

Preferred electrospinning techniques are disclosed in U.S. patent application Ser. No. 10/548,203, PCT Application No. US2004/06868, filed Mar. 8, 2004 (WO 2004/080217A1) and U.S. Provisional Application Ser. No. 60/452,543, filed Mar. 7, 2003, PCT Application No. US2004/006812, filed Mar. 8, 2004 (WO 2004/080681A1) the entire contents of which are incorporated herein in their entirety.

The electrostatically produced fibers preferably comprise a three-dimensional non-woven fibrous structure composed of polysaccharide microfibers or nanofibers alone or in admixture with other polymeric fibers. The fibrous structure and/or fiber encapsulates or entrains an active agent (mobile additives or adjuvants) which are quickly released when the structure is exposed to an activating (releasing) agent which disrupts or dissolves the structure.

The active agent can be entrained in the fiber structure itself or in the non-woven fibrous structure itself or both.

The electrospun liquid may be prepared by dissolving or otherwise dispersing the polysaccharide, the active agent and any other ingredients present to form a polymeric fluid. When the fluid is subject to an electroprocessing technique, the solvent or dispersant is evaporated and nanofibers and/or microfibers are produced. The fibers are collected in the form of a non-woven structure having the active agent entrained within the fibers.

Any water-soluble or water-dispersible polysaccharide or mixtures thereof may be employed in manufacturing the fibrous structures. These include alginates, carrageenans, gums, pectins, cellulose derivatives such as hydroxyethyl cellulose, methyl cellulose, hydroxypropyl celluloses, cellulose esters such as cellulose acetate, carboxymethyl cellulose, starch and its derivatives such as hydroxyethyl starch, sodium starch glycolate, pullulan, etc.

These polysaccharides may be admixed with other polymers or oligomers to create fibers of different morphologies or different dissolution rates or to modify other properties and characteristics of the fibrous structure. Polymers with single or multiple functionalities can be used to create interpolymer chains which crosslink in the fibers. Crosslinks can be used to tailor the swelling of the fibers, and thus control release rates. The fiber mat may also be a composite of electrospun (or not) fibers of different nature. A composite blend of fibers, such as polysaccharide and cellulose acetate fibers (easily spun from acetone solutions) could improve handling of the fibers, depending on end use requirements. Handling could also be improved using sandwich or multi-layer composite structures. The fiber mat could be coated with a protective layer, which offers protection prior to actual use. Other formulations and combinations could readily be envisioned.

As discussed, other embodiments include: composite structures, intermixed fibers produced by other than electrospinning processes, etc. Along the same lines, the mobile (active) agents themselves could be entrained among the fibers that comprise fibrous structure. This could potentially be achieved by superimposing a process that delivers the mobile or active agents into the fibrous structure during or after fibrous structure formation. Simultaneous electrospinning or electrospraying, powder or hot melt spraying or coating, wet impregnation, etc. are some techniques that could be used to disperse an active ingredient within the nonwoven fibrous structure during or after the formation of the primary fibrous structure. If the active agent is not directly admixed with the primary fibrous components and is applied separately, the active agent may be dissolved or dispersed in a medium that may or may not dissolve the electrospun primary fibrous structure. If the carrier of active agent dissolves the fibrous structure, then it is expected that the active agents may be dispersed both within and among the fibers of the fibrous structure.

An advantage of the electrospinning process is that it can be carried out at room temperatures so that highly volatile or thermally unstable active agents can be effectively encapsulated within the electrospun fibers.

Suitable natural and synthetic polymeric materials which can be electro-co-spun or co-sprayed with polysaccharides include polyvinyl alcohols, polyvinyl acetates, cellulose acetates, polyethylene oxides, polyesters, polyamides, polyurethanes, elastomeric polymers, polyolefins, polyacryonitriles, polyvinyl halides, polyvinylidene halides, polycarbonates and the like. Suitable proportions of polysaccharide and the aforementioned polymeric materials range from about 99-1 wt. % of polysaccharide to about 1-99 wt. % polymeric material, preferably about 25-75% polysaccharide to about 75-25 wt. % polymeric material and most preferably about 40-60 wt. % polysaccharide and 60-40 wt. % polymeric material.

Active agents which can be attached to, entrained within or encapsulated by the fibrous structure of the electrostatically produced fibers encompass a wide variety of materials. Preferably, the active agents include drugs, pharmaceuticals and/or flavorants. Suitable drug substances can be selected from a variety of known classes of drugs including, for example, analgesics, anti-inflammatory agents, anthelmintics, antiarrhythmic agents, antibiotics (including penicillin), anticoagulants, antidepressants, antidiabetic agents, antipileptics, antihistamines, antihypertensive agents, antimuscarinic agents, antimycobacterial agents, antineoplastic agents, immunosuppressants, antithyroid agents, antiviral agents, anxiolytic sedatives (hypnotics and neuroleptics), astringents, beta-adrenoceptor blocking agents, blood products and substitutes, cardiac inotropic agents, corticosteroids, cough suppressants (expectorants and mucolytics), diagnostic agents, diuretics, dopaminergics (antiparkinsonian agents), haemostatics, immunological agents, lipid regulating agents, muscle relaxants, parasympathomimetics, parathyroid calcitonin and biphosphonates, prostaglandins, radiopharmaceuticals, sex hormones (including steroids), anti-allergic agents, stimulants and anorexics, synpathomimetics, thyroid agents, PDE IV inhibitors, NK3 inhibitors, CSBP/RK/p38 inhibitors, antipsychotics, vasodilators and xanthines.

A suitable dosage and the form thereof, such as oral or parenteral form, including pulmonary administration, may be designed by judicious consideration of polymeric carriers, in terms of their physico-chemical properties as well as their regulatory status. Other pharmaceutically acceptable excipients may be included. The pharmaceutical excipients might also have other attributes, such as absorption enhancers.

Electrospun pharmaceutical dosage and form may be designed to provide rapid dissolution, immediate, delayed, or modified dissolution, such as sustained and/or pulsatile release characteristics.

Suitable flavorants or odorants may or may not be water soluble and include but are not limited to alcohol, acid, ester, aldehyde odorants, lactones, cyclic, bicyclic or acyclic terpenoid odorants, ionones, irones, damascones, pyrazines, etc. The flavorants may be composed of individual flavor chemicals or mixtures present in natural extracts or formulated independently for specific sensorial impact. Suitable flavors include eucalyptol, thymol, cumin oil, menthol, wintergreen, mint-flavored oils, citrus-flavored oils, vanilla extracts, lime oil, tobacco extracts, berry extracts, lemon grass, dimethyl pyrazine and the like. The amount of flavorant will vary widely depending on utility and taste requirements. In general, the flavorant would be added in amounts from about 0.25 to about 10% weight/weight of the formulation, preferably 0.50 to about 5%, most preferably about 1 to 3%.

Various other additives may be present including crosslinking agents, surfactants, viscosity and pH modifiers, plasticizers, dyes and colorants, fillers, buffering agents, absorption enhancers, etc. These additives could be used to modify the rate of dissolution or disruption of the fiber structure or the handling of the fiber structure among other properties.

The polymeric composition may be electroprocessed as a solution, dispersion or emulsion. Solvent choice is based upon the solubility of the polymer encapsulant of the dispersed or dissolved active agent. Suitably, water is the best solvent for a water soluble active agent, and a water soluble polymer. Alternatively, water combined with a water-miscible organic solvent may be used. It may be necessary to use an organic solvent to prepare a homogeneous solution of the active agent and polysaccharide when the active agent is non-water soluble, or sparingly soluble. Further alternatively, a dispersion or an emulsion of an active agent not soluble in the polymer solvent may also be electrospun. In this case, the active agent is effectively encapsulated within the polymeric fibers as in a matrix type encapsulation.

The polymeric composition may also contain additional additives such as plasticizers. Plasticizers are employed to assist in providing the desired feel and plasticity for the resulting non woven fiber mats. Exemplary plasticizers that may be employed include triethyl citrate, triacetin, tributyl citrate, acetyl triethyl citrate, acetyl tributyl citrate, dibutyl phthalate, dibutyl sebacate, vinyl pyrrolidone, propylene glycol, glycol triacetate, polyethylene glycol, or polyoxyethylene sorbitan monolaurate and combinations or mixtures thereof.

Suitable solvents for use herein include, but are not limited to, water, acetic acid, acetone, acetonitrile, methanol, ethanol, propanol, ethyl acetate, propyl acetate, butyl acetate, butanol, N,N dimethyl acetamido, N,N dimethyl formamide, 1-methyl-2-pyrrolidone, dimethyl sulfoxide, diethyl ether, disisopropyl ether, tetrahydrofuran, pentane, hexane, 2-methoxyethanol, formamide, formic acid, hexane, heptane, ethylene glycol, dioxane, 2-ethoxyethanol, trifluoroacetic acid, methyl isopropyl ketone, methyl ethyl ketone, dimethoxy propane, methylene chloride, etc., or mixtures thereof.

Parameters affecting electrospinning are viscosity, surface tension, and electrical conductivity of the solvent polymeric composition. The solvent to polymeric composition ratio can be determined by the desired viscosity of the resulting formulation. Increasing the polymer concentration increases the viscosity of the solution and vice versa. The same is true, in general, in the case of a dispersion of an insoluble active agent (adjuvant or mobile additive); as the concentration of the dispersant increases the viscosity of the dispersion increases. Depending on processing or end use requirements, the skilled in the art formulators may employ any or combinations of the following additives: viscosity modifiers, surfactants, plasticizers, etc.

Viscosity modifiers include water soluble polymers and latexes or solvent soluble polymers. Representative examples of viscosity modifiers include but are not limited to: Pluronics® (block copolymers of ethylene oxide and propylene oxide), Carbopol Aqua™, polyethylene glycols, modified cellulosics, etc.

Modifiers such as surfactants are added on a weight/weight basis to the composition. Suitable surfactants are added in amounts of about 0.1% to 10%, preferably about 1% to 8%, and most preferably about 1% to 5%. Surfactants can lower the surface tension of the formulation, but higher amounts may adversely affect the quality of the electrospun fibers. Examples of surfactants include but are not limited to: lecithin, Aerosol OT™ (sodium dioctyl sulfosuccinate), sodium lauryl sulfate, polyoxyethylene sorbitan fatty acid esters, i.e. the polysorbates such as Tween™, such as Tween 20, 60 & 80, the sorbitan fatty acid esters, i.e. sorbitan monolaurate, monoleate, monopalmitate, monostearate, etc., such as Span™ or Arlacel™, Emsorb™, Capmul™, or Sorbester™, Triton X-200, polyethylene glycols, glyceryl monostearate, Vitamin E-TPGS™ (d-alpha-tocopheryl polyethylene glycol 1000 succinate), sucrose fatty acid esters, such as sucrose stearate, sucrose oleate, sucrose palmitate, sucrose laurate, and sucrose acetate butyrate, etc.

Suitable utilities for the fibrous structures include the following: electrospun polysaccharide fibers containing flavorants may be used to improve flavor delivery in cigarette applications; electrospun polysaccharide fibers containing flavorants may be used in air fresheners; electrospun polysaccharide fibers containing flavorants may be used as mouth cleaning and/or mouth soothing active agents in oral hygiene or dental products; electrospun fibers may contain biodegradable bioadhesive controlled release systems of nanoparticles similar to those described in U.S. Pat. No. 6,565,873; electrospun polysaccharide fibers containing active agents with medicinal properties or drugs may be used in pads, swabs or bandage type designs; electrospun polysaccharide fibers may be used as viscosity modifiers (coating formulations, food processing, etc.); electrospun polysaccharide fibers containing encapsulated active agents may be used in food items to deliver a particular flavor, vitamins, neutraceuticals, or taste sensation. The fibers may also be used to encapsulate and immobilize and protect systems such as proteins and enzymes or color indicators with potential applications in biomedical sensors. Other uses for the fibrous structures would be readily apparent to those skilled in the art.

A preferred embodiment elates to the manufacture of smoking articles which include a fibrous structure composed of polysaccharide nanofibers having an active agent such as flavorants entrained therein. When the article is smoked, moisture in the tobacco smoke will contact the fibrous structure and begin to disrupt or dissolve the structure thereby releasing the flavorant. The rate of dissolution and release can be varied by modifying the fibrous structure. For example, the use of cross-linking agents and polymeric modifiers of varying solubility would have an effect on dissolution and subsequent delivery of flavorant.

Suitable cross-linking agents and methods of using same are disclosed in the article by W. E. Hennick and C. f. van Nostrum entitled "Novel crosslinking methods to design hydrogels," *Advanced Drug Delivery Reviews* 54 (2002), pp. 13-36, the entire disclosure being incorporated herein in its entirety.

In yet a different embodiment, the encapsulated active agent may include a selective or non-selective adsorbent or catalyst system which upon dissolution of the protective electrospun polymeric sheath adsorbs or facilitates catalytic reactions with smoke constituents in the main stream smoke of cigarettes.

In yet another embodiment, the electrospun polymeric fibers themselves may have selective or non-selective adsorptive properties for cigarette smoke constituents. In this case, the electrospun fibers are more adsorptive than conventional fibers due to their increased surface to volume ratio resulting from their small diameter. Electrospun fibers have diameters orders of magnitude less than conventional fibers made from dry or solution spinning.

In a preferred embodiment, the non-woven fibrous mat containing an encapsulated active agent such as a flavorant is located in a filter portion of a cigarette. Typically, about 10 to about 300 mg of the fibrous mat can be incorporated into the filter portion, preferably about 50 to 200 mg, and more preferably about 75 to 125 mg. Various filter constructions may be employed to locate the fibrous mat. Examples of suitable filter structures that can be used include, but are not limited to, a dual filter, a triple filter, a single or multi-cavity filter, a recessed filter or a free-flow filter. Dual filters typically comprise at least two, usually different, types of filter plugs. Dual filters typically include a mouthpiece filter plug constructed of cellulose acetate or a creped filter paper material. In such dual filters, the fibrous mat is preferably located closer to the smoking material or tobacco side of a cigarette filter. The length and pressure drop of the two segments of the dual filter can be adjusted to provide optimal adsorption, while maintaining acceptable draw resistance.

Triple filters can include mouth and smoking material or tobacco side segments, and a middle segment. The fibrous mat can be provided in the middle segment. Cavity filters typically include two segments, e.g., acetate-acetate, acetate-paper or paper-paper, separated by a cavity. The fibrous mat can preferably be provided in the cavity. Recessed filters include an open cavity on the mouth side, and the fibrous mat can be incorporated into the cavity. The filters may also optionally be ventilated, and/or comprise sorbents such as activated carbon, charcoal or magnesium silicate, catalysts, flavorants or other active agents.

Figure 2:
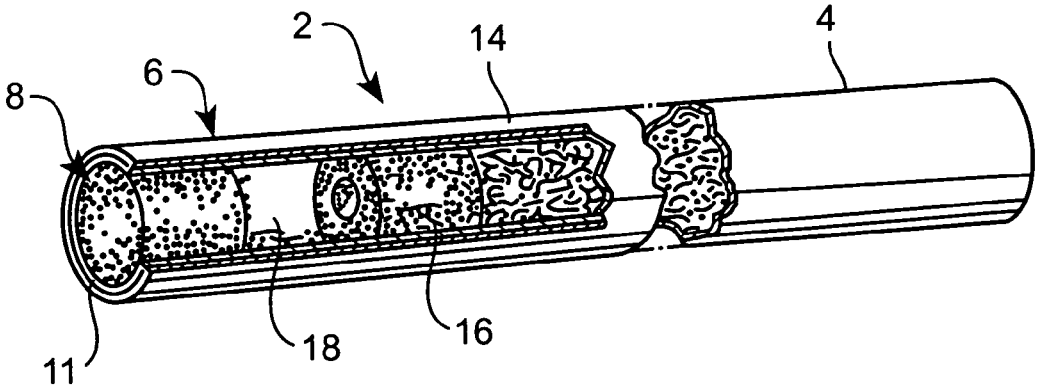
FIG. 2 is a view of one embodiment wherein an electrospun fibrous mat encapsulating a flavorant is incorporated in a plug-space-plug filter element.

In the embodiment shown in FIG. 2, a plug/space/plug (P/S/P) filter is attached to a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may include a filter overwrap 11. The fibrous mat is preferably incorporated into the space 18.

In an alternative arrangement, a cigarette filter may have a plug/space (P/S) configuration including a downstream plug and a space. The electrospun fibrous mat containing encapsulated flavorant may be incorporated into the space.

In another embodiment, a cigarette filter comprises sorbent (such as an activated carbon) at an upstream location along the filter to remove smoke constituents and electrospun fibrous mat containing encapsulated flavorant at a downstream location along the filter to release flavorant to mainstream smoke after it has been drawn through the sorbent.

The electrospun fibrous mat preferably is incorporated into a hollow portion of a cigarette filter. Some filters have a plug/space or plug/space/plug arrangement in which the plugs may comprise a fibrous filter material and the space is simply a void in the filter. That void can be filled with the fibrous mat containing a flavorant as shown in FIG. 2. Upon smoking the cigarette, the fibrous web begins to dissolve when contacted by moisture and the flavorant is gradually released.

Most cigarette filters contain four main constituents: filter tow, plasticizer, plug wrap and adhesive. Often the filter tow comprises a bundle of cellulose acetate fibers or papers, that are bound together using the plasticizer, which acts as a hardening agent. The filter is contained in the plug wrap, usually a paper wrapper, which is secured using an adhesive. The flavorant containing fibrous mat can be incorporated in any part of the filter. Any conventional or modified method of making cigarette filters may be used to incorporate the fibrous mat.

Another embodiment relates to methods for making cigarettes. For example, one method comprises: (i) providing a cut filler to a cigarette making machine to form a tobacco column; (ii) placing a paper wrapper around the tobacco column to form a tobacco rod; and (iii) attaching a cigarette filter containing the previously described fibrous mat to the tobacco rod to form the cigarette.

The filter section may be comprised of electrospun fibers only or as previously described fiber mats composed of conventional and electrospun fibers. Filters made of electrospun fibers may contain active agents such as flavorants to increase the taste of cigarette smoke, while at the same time functioning as filtration medium for particulate and selective or non-selective gas or semivolatile phase component filtration, respectively.

EXAMPLE

Pullulan is dissolved in water to form an aqueous solution of 25% concentration by weight. A water-soluble flavorant is added and the solution electrospun to form a fibrous mat whose fibers are nanosized and where the flavorant is encapsulated within the mat. Ethanol may be used at about 20 wt % concentration to aid polymer dissolution and improve electroprocessing. Blowing moist air on the fibrous mat dissolves the water-soluble fibers and releases the flavorant.

Flavorants which may be successfully encapsulated include eucalyptol, thymol, cumin oil, menthol and various mint-type flavors, vanilla extract, tobacco extracts, lime oil, dimethyl pyrazine, berry extracts and lemon grass. Blowing moist air on the fibrous mat dissolves the water-soluble fibers and releases the flavorant.

While the invention has been described in detail with reference to specific embodiments thereof, it will be apparent to those skilled in the art that various changes and modifications can be made, and equivalents employed, without departing from the scope of the appended claims.

What is claimed is:

1. A cigarette including a fibrous structure located in a filter of said cigarette, wherein the fibrous structure comprises a fibrous web of electrospun polysaccharide nano- or micro fibers having an active agent encapsulated within the fibrous structure.

2. The cigarette according to claim 1, wherein the fibers have a diameter ranging from about 1 nanometer to about 10 microns and are produced by electrostatically processing an aqueous dispersion or solution containing a polysaccharide and an active agent and recovering a three-dimensional fibrous web comprising the polysaccharide encapsulating the active agent, wherein the polysaccharide is present in the solution or dispersion in an amount of about 20% to about 60% by weight, the polysaccharide comprises an alginate, a carrageenan, a gum, a pectin or pullulan, and the active agent comprises a pharmaceutical, flavorant, odorant, selective absorbent catalyst, protein or immobilized enzyme.

3. The cigarette according to claim 1, wherein the polysaccharide comprises pullulan, and the active agent is a flavorant.

4. The cigarette according to claim 1, wherein the fibrous structure is a non-woven three-dimensional fibrous structure comprising polysaccharide nano- or microfibers and the active agent encapsulated within the fibrous structure.

5. The cigarette according to claim 4, wherein the polysaccharide comprises pullulan and the active agent comprises a pharmaceutical, a flavorant and/or an odorant.

6. The cigarette according to claim 5, wherein the odorant comprises at least one alcohol, acid, ester, aldehyde odorants, lactones, cyclic, bicyclic or acyclic terpenoid odorants, ionones, irones, damascones or pyrazines and the flavorant comprises menthol, eucalyptol, thymol, cumin oil, mint-type flavors, vanilla extracts, tobacco extracts, lemon or lime oil, dimethyl pyrazine, berry extracts or lemon grass.

7. The cigarette according to claim 6, wherein the flavorant comprises menthol.

8. The cigarette according to claim 4, wherein the polysaccharide fibers are cross-linked.

9. The cigarette according to claim 4, wherein the non-woven three-dimensional fibrous structure is prepared by a process comprising electrospinning an aqueous composition containing a polysaccharide and the active agent and collecting the fibers on a collector.

10. The cigarette according to claim 9, wherein the aqueous composition contains at least one additive selected from viscosity modifiers, surfactants, pH buffers or cross-linking agents.

11. The cigarette according to claim 9, wherein the aqueous composition contains an additional polymer.

12. The cigarette according to claim 11, wherein the additional polymer comprises a cellulose ester.

13. The cigarette of claim 1, wherein the polysaccharide comprises pullulan and the active agent is a flavorant comprising menthol.

14. The cigarette of claim 1, wherein the polysaccharide comprises pullalan, an alginate, carageenan, gum, pectin, starch or a modified cellulose and the active agent is a flavorant comprising menthol, mint-flavored compounds, eucalyptol, berry extracts, citrus extracts or tobacco extracts.

15. The cigarette of claim 1, wherein the fibrous structure comprises a polymer in addition to the polysaccharide.

16. The cigarette according to claim 1, wherein the fibrous structure is a three-dimensional nonwoven fibrous structure prepared by:

(a) preparing an aqueous solution or aqueous dispersion comprising a polysaccharide and an active agent;

(b) electrostatically spinning the solution or dispersion through a capillary delivery device under the influence of an electric field; and (c) collecting the spun solution or dispersion on a collector in the form of said fibrous structure, wherein the polysaccharide is present in the solution or dispersion in an amount ranging from about 20 to 60 wt. % and the active agent is present in an amount ranging from about 0.25 to 10 wt. %.

17. The cigarette according to claim 16, wherein the polysaccharide comprises an alginate, a carrageen, a gum, a pectin or pullanan and the active agent comprises a pharmaceutical and/or a flavorant.

18. The cigarette according to claim 16, wherein the aqueous solution or dispersion contains an additional polymer, the weight ratio of polysaccharide to polymer is about 25-75% to about 75-25%, the active agent is menthol, and the polysaccharide is pullalan.

19. The cigarette according to claim 16, wherein the fibrous structure is reacted with a cross-linking agent.

20. A filter of a smoking article comprising a fibrous web composed of electrospun polysaccharide nano- or-micro fibers having an active agent encapsulated within the fibrous structure.

21. The filter of claim 20, wherein (a) the fibrous web comprises a polymer in addition to the polysaccharide or (b) the polysaccharide comprises pullulan, alginates, carageenans, gums, pectins, starch and modified celluloses and the active agent is a flavorant comprising menthol, mint-flavored compounds, eucalyptol, berry extracts, citrus extracts or tobacco extracts.

22. The filter of claim 21, wherein the polymer comprises a cellulose ester.

23. The filter of claim 20, located in a cigarette, wherein the polysaccharide comprises pullalan and the active agent is a flavorant comprising menthol.

24. A cigarette comprising the filter of claim 20, wherein a sorbent is located upstream of the fibrous structure.

* * * * *